US008511497B2

(12) United States Patent
Foster, Sr.

(10) Patent No.: US 8,511,497 B2
(45) Date of Patent: Aug. 20, 2013

(54) COLLAPSING GARBAGE CAN

(76) Inventor: Robert Foster, Sr., Mobile, AL (US)

( * ) Notice: Subject to any disclaimer, the term of this patent is extended or adjusted under 35 U.S.C. 154(b) by 0 days.

(21) Appl. No.: 13/357,765

(22) Filed: Jan. 25, 2012

(65) Prior Publication Data

US 2012/0145709 A1 Jun. 14, 2012

Related U.S. Application Data

(63) Continuation of application No. 11/880,020, filed on Jul. 18, 2007, now abandoned, which is a continuation-in-part of application No. 10/755,924, filed on Jan. 12, 2004, now abandoned, which is a continuation-in-part of application No. 10/057,856, filed on Jan. 23, 2002, now abandoned.

(60) Provisional application No. 60/264,221, filed on Jan. 25, 2001.

(51) Int. Cl.
*B65D 6/18* (2006.01)

(52) U.S. Cl.
USPC ..... 220/6; 220/8; 220/666

(58) Field of Classification Search
CPC ..... B65D 6/18; B65D 6/22; B65D 6/24; B65D 6/26
USPC ..... 220/4.01, 4.26, 6, 8, 666, 908
See application file for complete search history.

(56) References Cited

U.S. PATENT DOCUMENTS 4,392,605 A * 7/1983 Backman ..... 229/101
5,050,794 A * 9/1991 Wischusen, III ..... 229/125.26
6,991,124 B1 * 1/2006 Palley et al. ..... 220/1.5

* cited by examiner

*Primary Examiner* — Stephen Castellano

(57) ABSTRACT

A collapsing garbage can is shown as a feeder for garbage bags. A five sided design is taught where top and bottom punch out sections secure the top section relative to the bottom section. Top sections of the can to be made of absorbent or recyclable materials such as paper and cardboard while the base is made of a water resistant material so it may be used on a variety of surfaces. The sides of the top and bottom section flex so that it may fold flat and be expanded. The top section may be collapsed down inside the bottom section to reach a bag in the bottom section so when the top section is raised; the bag comes up with the top section.

5 Claims, 13 Drawing Sheets

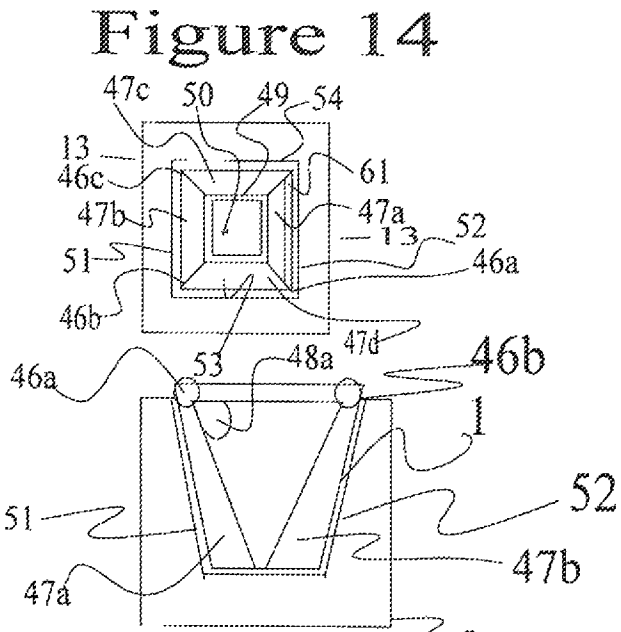
Figure 14
Figure 15
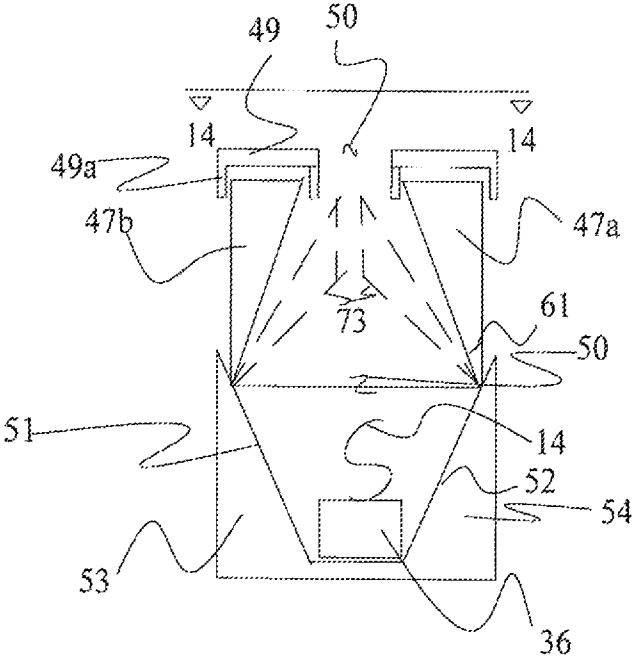
Figure 13

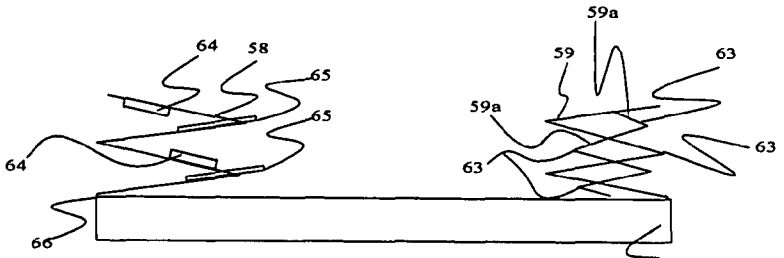
Figure 16
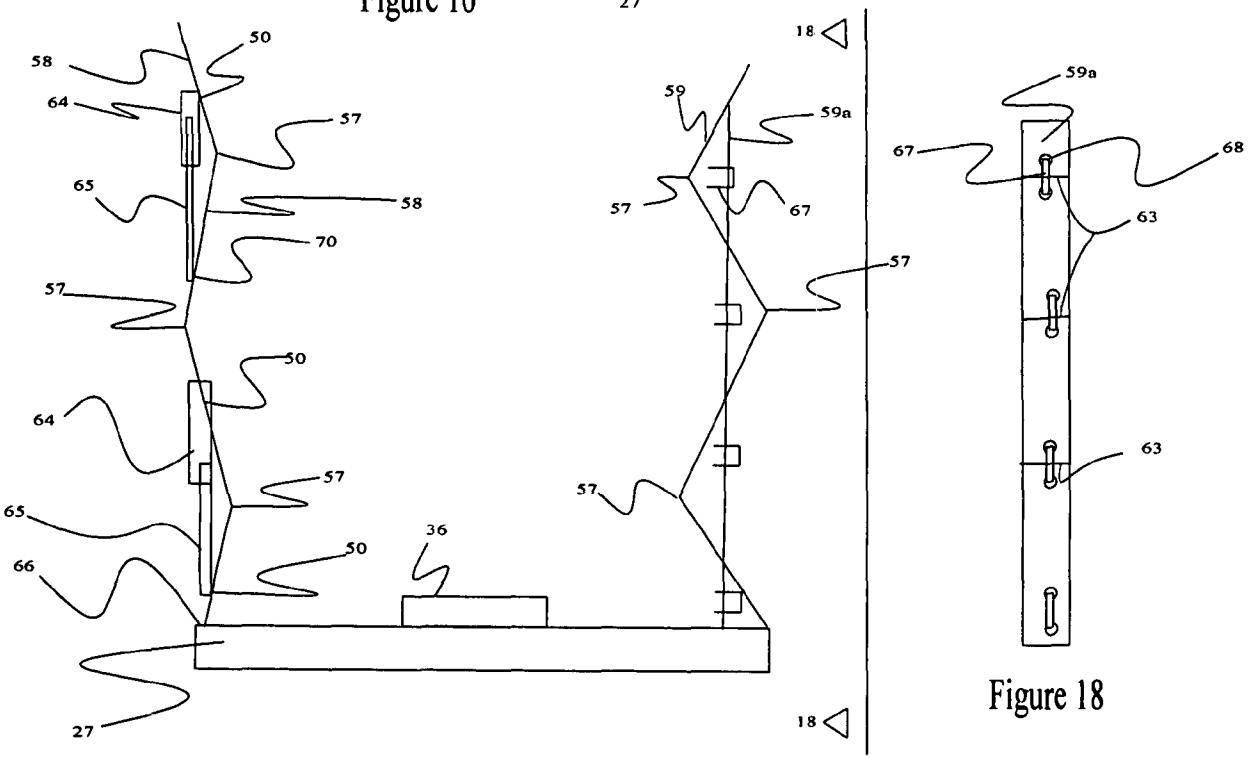
Figure 17
Figure 18

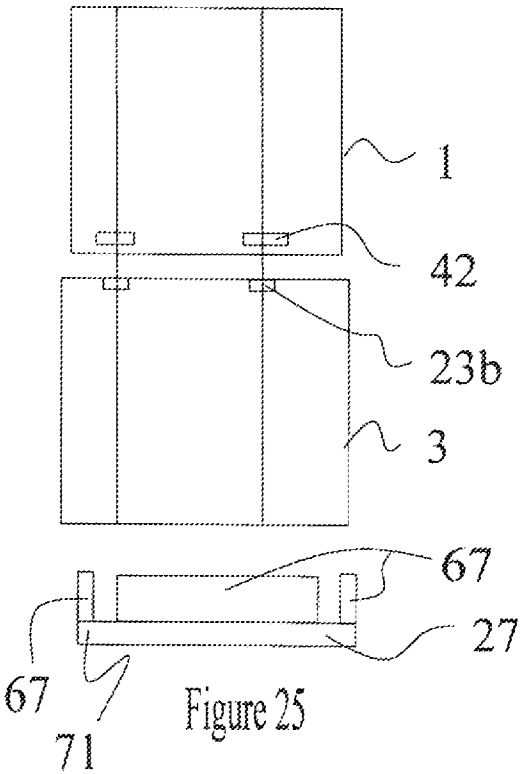
Figure 25
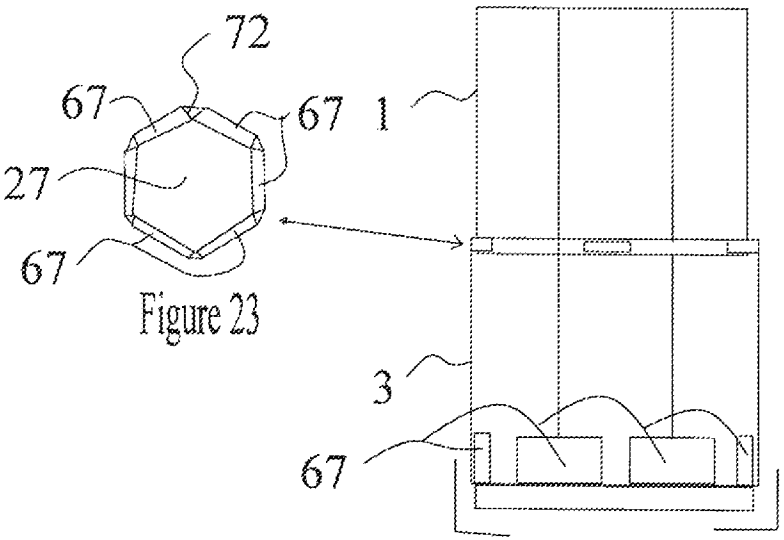
Figure 24
Figure 23

COLLAPSING GARBAGE CAN

PRIORITY CLAIM

This application is a continuation of Ser. No. 11/880,020 filed Jul. 18, 2007, now abandoned, which is a continuation-in-part (CIP) of Ser. No. 10/755,924 filed Jan. 12, 2004, now abandoned, which is a CIP of Ser. No. 10/057,856 filed Jan. 23, 2002, now abandoned, which claims priority to provisional Ser. No. 60/264,221 filed Jan. 25, 2001.

BACKGROUND OF INVENTION

1. Field of Invention

The invention pertains to garbage cans. The invention pertains to collapsible garbage cans.

2. Prior Art

Garbage cans containing trash bags are known in the art. Certain forms of spring loaded collapsing garbage cans are also known in the art.

GENERAL DISCUSSION OF THE INVENTION

The invention is a collapsing garbage can which further comprises a feeder for garbage bags and can be made of partially recyclable materials for easy disposal and limited reuse.

In many situations, particularly in a mobile environment it is important to have garbage cans which easily store. Typically this is done by stacking garbage cans.

The present invention is designed to improve storage options by providing a garbage can which is collapsible. In order to allow the garbage can to have a sufficient strength it can also be raised in a collapsible frame which can also secure the garbage can when the remainder of the garbage can is collapsed as described in more detail below.

Also, a garbage can is taught which collapses to make access to a roll of garbage bags.

Also, a can made with partially disposable and absorbent surfaces (paper or cardboard) is taught wherein those surfaces are coated with a scent to allow the smell to be pumped into the air when the can is collapsed and to allow those scents to disperse in the air otherwise. The can may be shrink wrapped when sold to hold in the smell.

It is an object of the invention to provide a garbage can which can collapse to be out of the way and in order to allow a garbage bag to be loaded from the bottom more easily and then raised to a full size or different size garbage can. The elevation of the bags one roller prevents them from being as affected by leaks.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF DRAWINGS

For a further understanding of the nature and objects of the present invention, reference should be made to the following detailed description taken in conjunction with the accompanying drawings in which like parts are given like reference numerals and wherein:

FIG. 13 shows a cross sectional view of a two part stacked version.

FIG. 14 shows a top view of the embodiment shown in FIG. 13.

FIG. 15 shows a side view of the embodiment shown in FIG. 13 folded for shipping.

FIG. 16 shows a cross sectional view of an alternative accordion style can with a left side locking mechanism different from the right side locking mechanism is the collapsed form.

FIG. 17 shows the embodiment of FIG. 16 raised.

FIG. 18 shows a side view of the right side locking mechanism.

FIG. 23 shows how the cutouts are formed on the corners of the invention.

FIG. 24 shows a side view of the invention.

FIG. 25 shows how the invention comes apart.

DETAILED DESCRIPTION OF THE PREFERRED EXEMPLARY EMBODIMENTS

Figure 1:
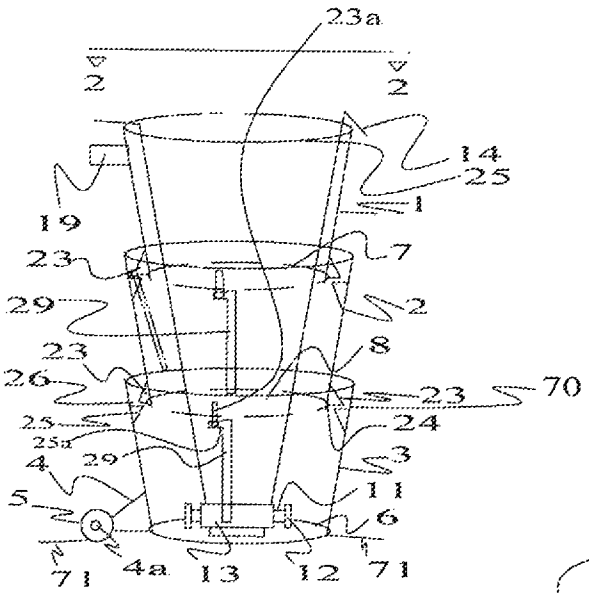
FIG. 1 shows a transparent line view collapsing garbage can comprising concentric funnel shaped barrels.

As can best be seen by reference to FIG. 1, the invention comprises at least two, but here, three sections; top section 1, middle section 2 and bottom section 3; each one slidable within the other. The bottom section 2 is attached to a wheel carriage 4 having at least one wheel 5. A handle 19 may be added to the top section 1 allow the invention to be moved and the wheel carriage 4 may be incorporated into the permanent frame in the fashion discussed hereinafter. The wheels are held on a wheel axle 4*a*.

The bottom section 3 is permanently attached to the wheel cart 4. The middle section, 2 slides out of the first section to a desired height and then is locked in place by a locking means which may be a frictional contact between top punchouts 23 of the top section and top resting face 24 of, for example, the middle section and bottom section. This contact may be any point of contact 70 between sections as shown in FIG. 1 between the middle and bottom sections where top resting face 24 is shown contacting bottom resting face 26.

Figure 5:
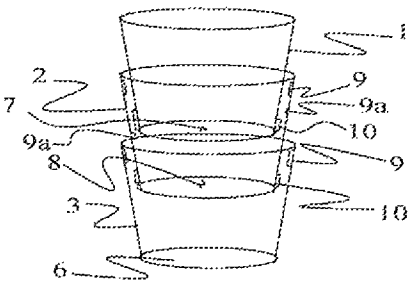
FIG. 5 shows an alternative embodiment with securing magnets.
Figure 6:
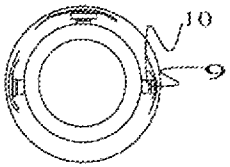
FIG. 6 shows a top view of the embodiment shown in FIG. 5.

The locking means in FIG. 1 is an elastic point of contact between extensions formed by elastic punch outs 23 and 25 here shown in the middle section and bottom section respectively. Cooperating hook and loop fasteners 26 or pins 23*a* which slide within slots 29 between sections 1, 2 and 3 may be used. Even magnets 9 and 10 (as shown in FIG. 5) could serve to lock the two locations together.

FIG. 1 shows a plurality of punch outs 23 each having a top resting face 23. There are also punch outs 25 each having a bottom resting face 26. The faces 24 and 26 contact one another to form a friction means for the frictional contact wherein the connection means comprises at least one friction means for frictionally contacting the middle section to the bottom section at at least one desired height and the top section to the middle section at least one desired height.

These punch outs 23 and 25 may either fold out, twist or be flexible so that they allow the top two sections 1 and 2 to slide into or out of the bottom section 3. In FIG. 1, the top pins 23*a* move within slots 29. The pins section 23*a* moves within a groove 29 within the middle section 2 and when fully raised, the top section 1 is twisted so that pins 23*a* rest on slot resting face 25*a*. The stop wall 30 prevents over turning the cans when the top punch out 23 is over and can rest on the bottom punch out 25. To lower the top section relative to the bottom section, the user need only untwist the top punch out 23 so it can move back down the grooves 29.

Figure 3:
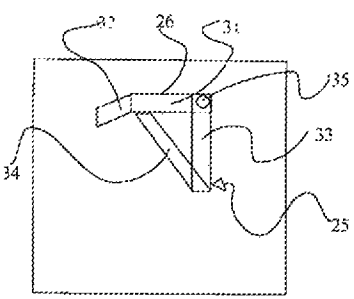
FIG. 3 shows a detail of punch out.

These punch outs 23 and 25 and pins 23 a can be added or made from the box itself as shown in FIG. 3. As shown in FIG. 3, box sections 31 partially cut out from space 32 of the box and sections 33 cut out from resulting space 34 of the box are joined by rivet 35 (or other joining means such as glue) to make one of the punch out section 25 (punch out 23 could be made the same way facing down) which are partially punched out but still partially connected to the top, middle or bottom sections. This same technique may be used with related parts, tubes 64 and tube inserts 65, discussed later in the specification with reference to FIGS. 16 and 17.

Figure 4:
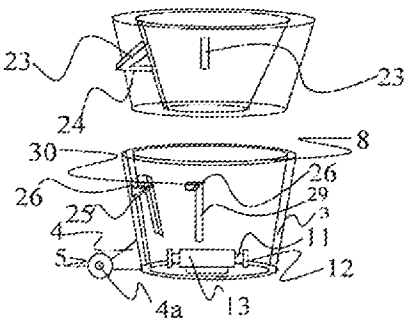
FIG. 4 shows a detail of a top punch out section in a slot.
Figures 7, 8:
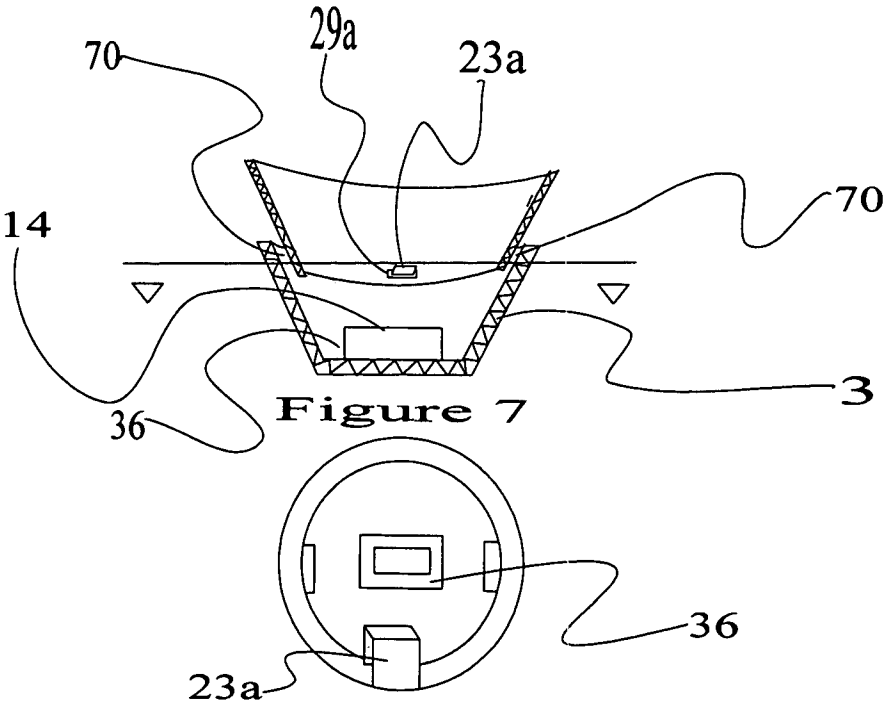
FIG. 7 shows a punch out support embodiment.
FIG. 8 shows a top view of the embodiment shown in FIG. 7.

By twisting and lowering sections the top section 1 and the middle section 2, the sections may be lowered or raised to allow the user to lower the top and middle sections to load a garbage bag from a roll 13 (FIG. 4) or box 36 (FIG. 8). FIG. 4 shows the top section lifted out of the bottom inside sections.

For ease of drafting, in the embodiment shown in FIG. 5, magnets 9 on the top of the lower two sections 2 and 3 and cooperating oppositely polarized magnets 10 on the bottom of the top two sections 1 and 2 serve to hold the sections up when they are lifted. If hook and loop fasteners were used, one side, 9 for example, would be replaced with hooks and the other side 10 would have be replaced with loops.

The top section 1 and middle section 2 define openings 7 and 8 respectively, and the bottom section 3 has a floor 6 to support any garbage and to hold the garbage bag roll 13.

The top section slides out of the middle section and the middle section slides out of the bottom section to the desired height of the garbage can. The can is locked in the manner described above and may be locked at differing levels as by magnets 9 and 9*a* shown in FIG. 5.

As can be seen by reference to FIG. 1, the wheel carriage 4 has wheels 5 mounted on an axle 4*a*.

Figure 9:
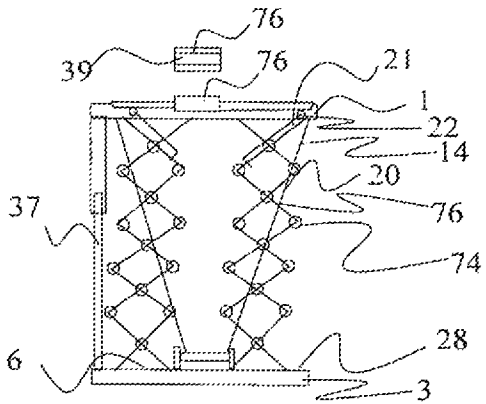
FIG. 9 shows an accordion style frame.
Figure 10:
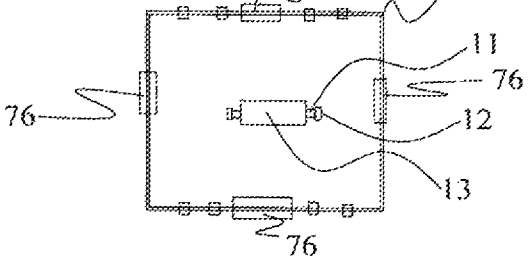
FIG. 10 shows a top view of the embodiment shown in FIG. 9.

As can best be seen by reference to FIGS. 1, 9 and 10 a spindle 11 on spindle arms 12 may hold a roll of garbage bags 13. This arrangement could be replaced with a box of garbage bags 36 held on the bottom 6 as shown in FIGS. 7 and 8. One benefit of this arrangement over prior arrangements with garbage bags similarly placed is the ability to collapse the can to better feed and attach the garbage bags. Another benefit lies providing a partially or completely disposable can as.

FIG. 9 shows at least one hole 29*a* in top section 1 which receives at least one punch out 23*a* in a bottom section 3 to hold the top section 1 in the raised position.

The box 36 may be water proofed so that the garbage bags are protected from leakage.

In this way the garbage can may be collapsed, then a garbage bag still on the roller 11 installed over the top rim 25 of the top section 1 (shown in FIG. 2) and then the entire garbage can raised with the attached garbage bag 14 automatically carried upward to end in the raised location as shown in FIG. 1.

One alternative to having multiple sections as described above is shown in FIG. 9. FIG. 9 has a top section 1 which utilized a garbage bag 14 (or a cloth bag) to form the body. As shown in FIG. 9, this could comprise a collapsing bag 14 held by telescoping arms 20 with locking arms 21 attached to pivots 22 on the top section 15 to allow the top section 15 to be fixed in a raised position or locking arms 21 may be disengaged to allow the can top section 1 to be lowered to be closer to the bottom section 3.

As shown in FIG. 9 there may be one or more telescoping arms 37 which are shown. Pivots 38 may be locked in place with the locking arms 21 in a manner known in the art of telescoping arms 37. Pivots 39 on the outside allow collapsing movement when the locking arm 21 is removed.

The telescoping arms 37 may be used as a handle to pull the device to the desired location. The top section 1 receives clips 76 defining slots 74 which press the bag 14 against the top rim 75 of the top section 1 to keep the bag 14 in place as it is raised in any embodiment.

There is a step 28 defined by the bottom 6 of bottom section 3 of the garbage can which allows for the user to hold the bottom section 3 down while the top section 1 is raised.

Figure 2:
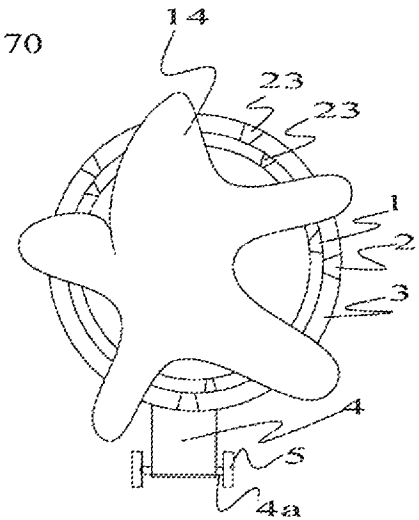
FIG. 2 shows a top view of the embodiment shown in FIG. 1.

FIG. 2 shows a handle 19 attached over the wheel 5. When the bottom section 3 is tilted towards the handle 19, the wheel 5 is against the floor, but the bottom 6 is partially or completely removed from the floor on which the device rests.

As can best be seen by reference to FIG. 9 clips 38 having a groove 39 which is designed to fit tightly over the perimeter of the top section 1 and may be used to fix the bag 14 in place (whether a garbage bag from a roll, a linen bag or both). Four such clips 38 are shown in FIG. 10, but more can be used so that two or more may hold a permanent bag and two or more may be used to hold a garbage bag above a linen bag.

In one embodiment, this invention could be practiced using disposable materials, particularly cardboard or paper which is corrugated or otherwise reinforced in order to maintain its shape.

In such an embodiment one of the primary benefits would be that the top sections 1 and 2 could be made of less expensive normal cardboard, and the bottom section 3 could be made out of water impermeable material such as waxed cardboard, or, for a more durable container, it could be made out of a corrugated plastic material.

Similarly, the bottom section 3 could be made out of cardboard and coated with a water proof material at the very bottom and possibly on the inside. This prevents leaks from damaging the container.

The outer cardboard is preferably water resistant. The purpose of doing this would be to allow the garbage can to be placed on a wet surface, or to allow wet materials to leak into the garbage can bottom section 3.

In an embodiment made out of cardboard, it would be beneficial to provide that the overlapping areas be aligned so as to maintain the alignment of the garbage can itself.

Figure 11:
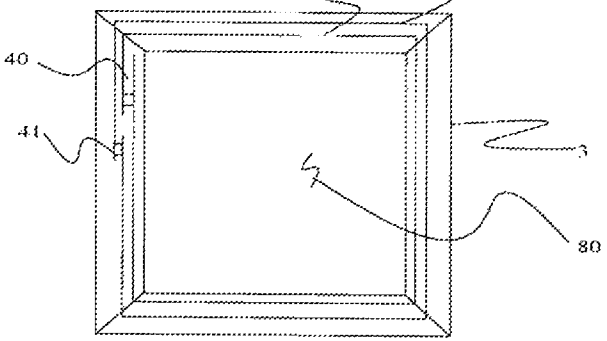
FIG. 11 shows a top view square cardboard type embodiment.
Figure 12:
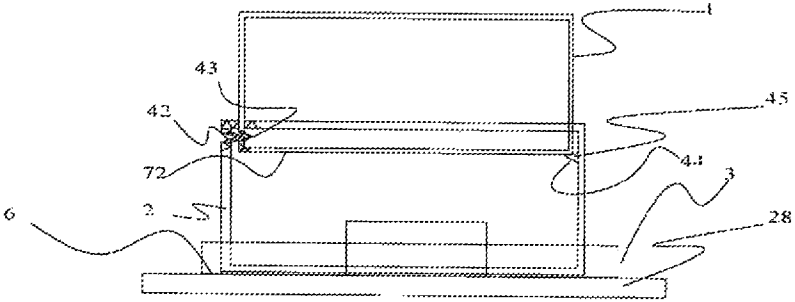
FIG. 12 shows a side cross sectional view of the embodiment shown in FIG. 11.

In one embodiment shown in FIGS. 11 and 12, the top section 1 is comprised of recyclable materials. The bottom section 3, is water resistant or non recyclable material. The top section 1 and middle section 2 are preferably made of standard cardboard. While here the entire bottom section 3 is taught as being water resistant, it is possible that only the floor 6 and extended step 28 would be water resistant.

Referring to FIGS. 11 and 12, it can be seen that the top section 1 and bottom section 3 (there is no middle section 2) are held in alignment by the overlaps 40 of the cardboard top section 1 and the overlap 41 of the cardboard bottom section 3. This is important because first cardboard punch out 42 in the middle section 3 fits in to a receiving punch out 43 in the top section 1 to support the top section 1 when it is raised. Also, as shown here, a bottom punch out 44 may be used to support the bottom perimeter 72 of top section 1. The user may push in the receiving punch out 43 to release the punch out 42. The handle openings 45 formed by the punch outs 44 and 42 may be used to lift the can.

A disposable bag dispenser is therefore described for improved moisture, decay and insect resistance, comprising;

a) a first water treated section having a top end and a bottom end and wherein the bottom end is closer to the ground when erected;

b) a first untreated cellulose material section having an upper end and a lower end, said lower end being fixed in place relative to the top end of the first treated section.

The purpose of having the bottom section 3 water resistant or made of water resistant material is in order to provide that the bottom layer will not be affected by moisture on the floor or from leakage from the garbage bag 14.

The treated bottom section 3 may form a container which would act as a water trap for the unit.

This invention may also be described as:

1. A device for holding garbage comprised of a first section having an interior and exterior which are waterproof or water resistant materials having a bottom and four sides coming up from the bottom;
2. a roll of garbage bags dispensable from the bottom of the said bottom section;
3. a middle section telescopically fitting within the first section and for extending the height of the bottom section;
4. a means for holding the position of the middle section relative to the bottom section in a raised position;
5. a top section telescopically fitting within the middle section said top section for extending the height of the middle section; and
6. a second holding means for holding the top section in the raised position relative to the middle section.

The invention may further be described as having at least the second and third sections constructed of recyclable material and more particularly corrugated paper products.

The invention may further be described by the materials of the bottom section which may include a waxed otherwise coated corrugated card board or paper type material or a corrugated plasticized material.

The top and middle sections may be further described as having outside diameters approximately the same as the inside diameter of the bottom section in which they fit for a frictional point of contact between the two sections when in the raised position in order to assist any other holding means in holding the raised sections 1 and 2 in place.

FIGS. 13, 14 and 15 show the invention can be made in sections out of disposable materials so that it may be assembled from a packed position shown in FIG. 15. There is a bottom section 3 and a top section 1. In this embodiment the top section 1 fits within a chamber, said chamber being defined by the sloping sides 51 and 52 of the bottom chamber 3.

When the box is at the desired location, the top section 1 is removed from the bottom section 3 and inverted and opened after placing the garbage bag container 36 on the floor of the bottom section 3.

The corners of the top section allow for the four sides 47*a*-47*d* of the top section to pivot outward from a resting position shown as dotted lines 73 in FIG. 13 to the open position shown as 47*b* and 47*a* in FIG. 13 and these in turn are held in place by a bracket 49 as shown FIGS. 13 and 14 which hold the four walls 47*a* through 47*d* of the top section 1 which has top pivoting corners 46*a* through 46*d* which rest against the sloping sides 51, 52, 53 and 54 of the bottom section 3.

When a new garbage bag is to be inserted the user may take off the bracket 49 and expand two of sections 47*a*-47*d* to reach through the gap formed between the two sections being opened or to lift the top section off.

It can best be seen in FIG. 13 that the bracket 49 has legs 49*a* which serve to secure the top of the two sides 47*b* and 47*a* as well as those not shown in FIG. 13, but can be seen in FIG. 14 which are sides 47*c* and 47*d*. Since the bracket 49 is a square as shown in FIG. 14, it serves to secure the entire section open.

It is possible that any one of the sides, in this case 47*a*, may have a bendable area 61 also shown in FIG. 14. The purpose of this is to allow the bracket 49 to be lifted off of the top section 1 so that it can then be folded down so that the user can reach in over that area in order to reach the box 36 in order to more easily load garbage bags.

The same bracket 49 can be used to secure the garbage bags 14 to the top of the top section 1.

Any embodiment The can may be made with partially disposable and absorbent surfaces (paper or cardboard) where those surfaces are coated with a aromatic scent to allow the smell to be pumped into the air when the can is collapsed and to allow those scents to disperse in the air otherwise. The can may be shrink wrapped when sold to hold in the smell. While the entire surface may be absorbent, when preferred, only the internal or external surface may be permeated with a scent.

Figure 19:
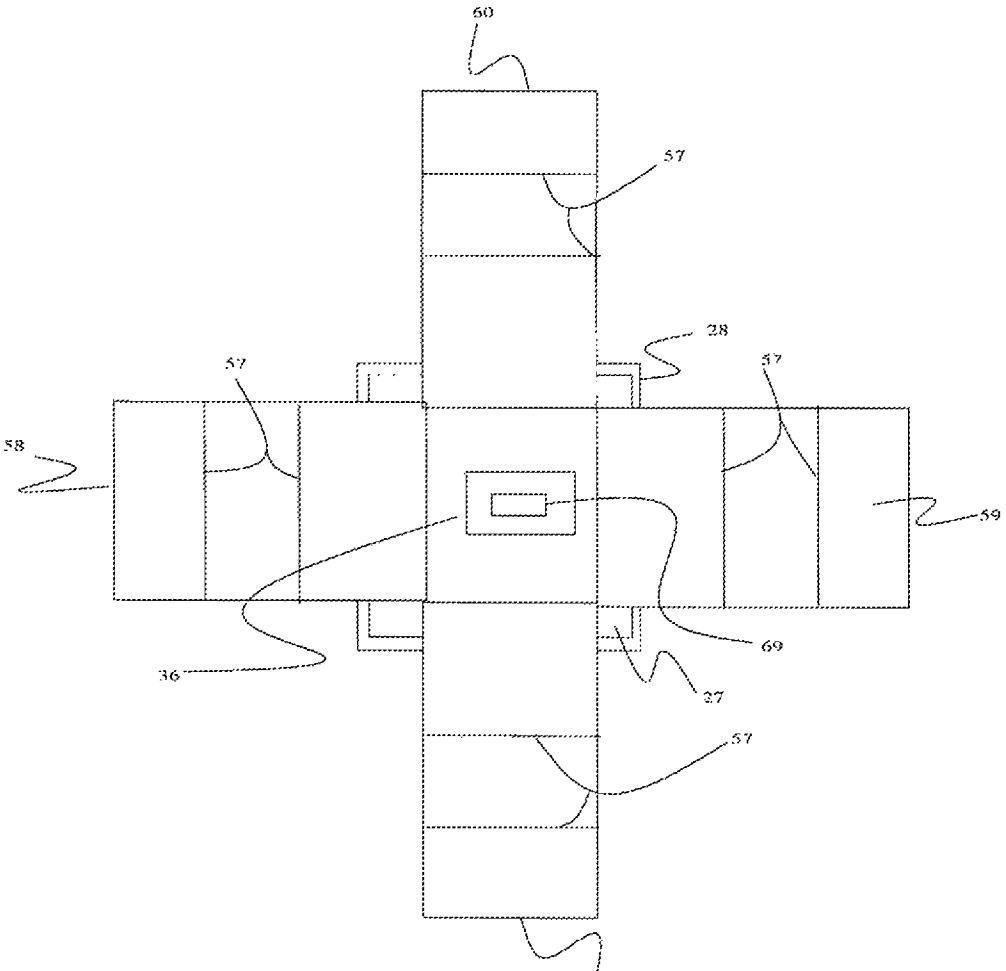
FIG. 19 shows the four sides of the bag shown in FIG. 16 folded out.

FIGS. 16-19 show an accordion model wherein the outside walls are 58, 59, 60 and 62 folded along creases 57 to the upward or folded position. The shape of the box can vary, but square boxes with four walls sides 58, 59, 60 and 62 as shown in FIG. 19 would be preferable.

The four walls, 58, 59, 60 and 62 are attached to a bottom 27 with steps 28 as shown in FIG. 19 or without steps 28 if the sides are attached at the edges of the bottom 27. While these walls are shown as folded out in FIG. 19, FIGS. 16 and 17 show how these walls may fold in an accordion style fashion.

FIGS. 16-18 show two differing securing means for holding the walls in the raised position. Referring to FIG. 17, when the walls are raised, wall 58 is held up by interlocking tubes 64 and tube inserts 65. These can be shown prior to insertion in FIG. 16. The tubes are preferably rotationally attached to the wall 58 at elastic attachment point 50. To allow for insertion and support the tube inserts 65 are preferably flexible and are flexibly attached to the wall 58 at elastic attachment point 50. These elastic attachment points 50 may be where the tubes 64 and tube inserts 65 are attached to the card-board or plastic of the wall. In fact, the tubes and inserts may be partially cut out from the walls except at the attachment points 50. Alternatively, they may be mechanically attached with pins or glues.

FIG. 17 shows how wall 59 is held up by accordion style support walls 59*a* which fold at creases 63 and are held apart at creases 63 by locking clips 67 which fit into holes 68 within the accordion support wall 59*a* on either side of the creases 63.

From the disclosure hereinabove it can be seen that the supports disclosed for wall 58 can be used with or in place of the supports for wall 59 and that the supports disclosed for wall 59 can be used with or in place of the supports for wall 58.

FIG. 17 shows how the box 36 containing garbage bags may be put in place when the sides 58, 59, 60 and 62 are lowered as shown in FIG. 16 and may be reloaded as necessary by re-lowering the garbage can from the raised position shown in FIG. 17 to the lowered position shown in FIG. 16.

The garbage can bottom 27 can sealed to hold or keep out fluids. If fluids are retained, it is useful to have the garbage bag dispenser raised as is shown in FIGS. 1, 9 and 10.

As defined previously punch outs may be replaced with other holding means such as clips 67 and the walls may be reinforced where the clips enter. In this embodiment the clips might be made of the same material that the disposable second layer is made out of in order to minimize the manufacturer costs.

In the preferred embodiment shown in FIGS. 23-26 there are punch outs 9 on the bottom of the top section receiving or contacting punch outs 42 from the top of the bottom section.

Figure 26:
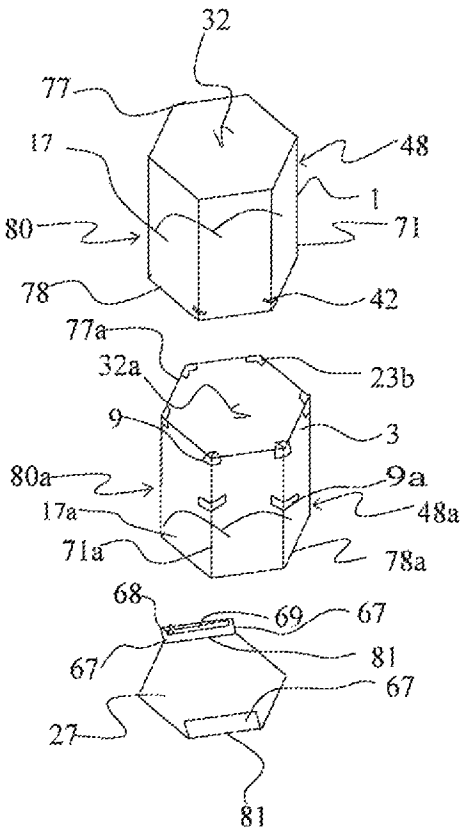
FIG. 26 shows a side and top view of the invention.
Figure 27:
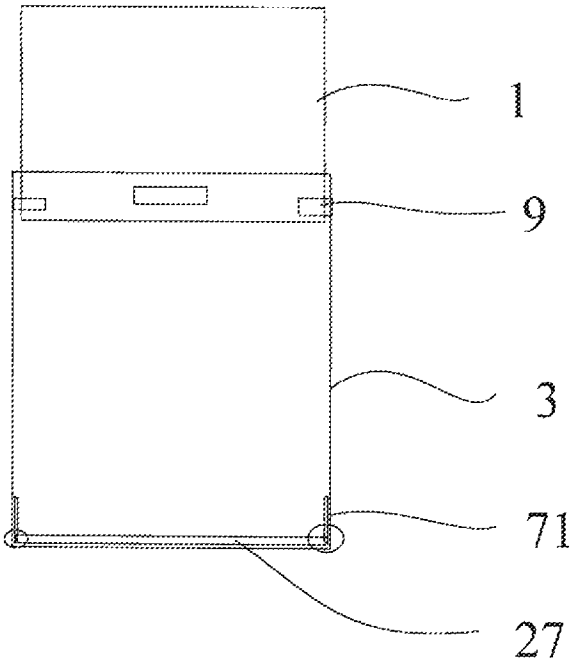
FIG. 27 shows a side view of the invention.

FIG. 25 shows a cross sectional view and FIG. 26 a 3 dimensional view of the preferred embodiment of the invention from these figures.

Referring to FIG. 26, the exploded view, it can be seen that the invention comprises 3 basic parts; a top section 1, at least one bottom section 3 and a base 27.

The location of punch outs may be such so as to allow a second set of punch outs on which the bottom of the top section rests when the punch outs near the bottom of the top section are held by the punch outs which are the same size as the top of the bottom section.

The purpose of having the multiple punch outs is to add strength to the can, which is also provided by having the five sided design, which is described below.

In the preferred embodiment the multi-sided can has five sides, each of which is slit in order to allow the corner to be punched in. If the punch outs are below the level of the top of bottom half, then the top portion fitting within the bottom portion can rest on these punch outs.

In a preferred embodiment there are punch outs on the bottom of the top section also receiving punch outs from the top and bottom section.

The location of these different punch outs may be such so as to allow a second set of punch outs on which the bottom of the top section rests when the punch outs near the bottom of the top section are held by the punch outs which are the same size from the top of the bottom section.

The purpose of having the multiple punch outs is to add strength to the can, which is also provided by having the five sided design, which is described here and above.

Figure 21:
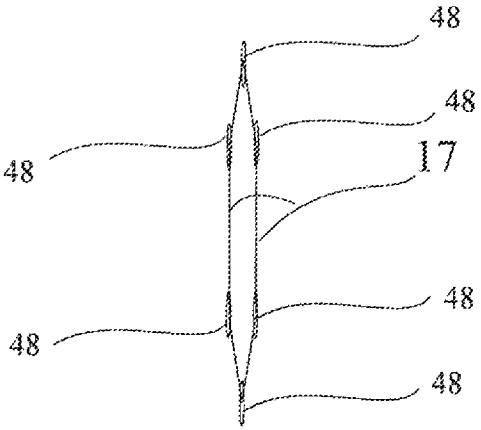
FIG. 21 shows the invention folded up.
Figure 20:
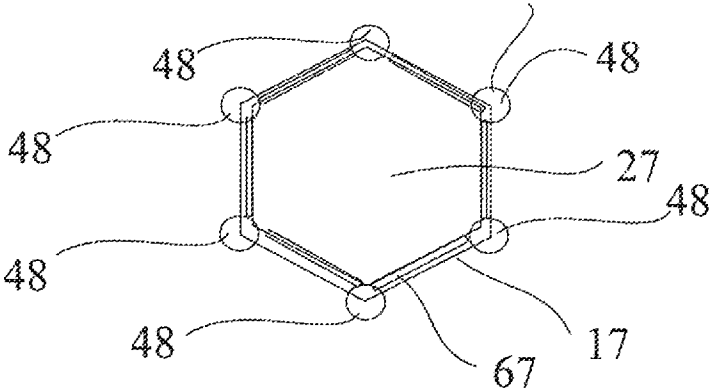
FIG. 20 shows a top view of the invention

As can best be seen by reference to FIG. 21, the invention folds up. This is because in the six-sided version shown in FIG. 21, each corner 48 of each side 17 is pivotably connected as represented by the circles 18 reflecting common flexing edges 71 of continuous material where the cardboard bends to form a flexible connection 48 between flat sides 17 for the top sections shown on FIGS. 20 and 26. Similarly, there are flexible connections 48*a* for the flexing edges 71*a* of the bottom section between flat sides 17*a*.

Figure 22:
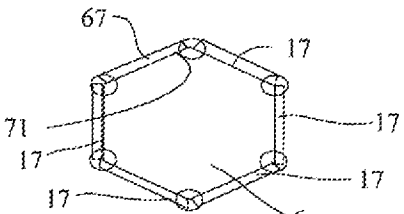
FIG. 22 shows how the corners are pivotably connected.

Here, there is at least one bottom flap 67 connected to the bottom 27 at a flexible edge 81 which is a flexible edge to the base 27 which base 27 provides a floor. The flaps 67 turn up and frictionally connect against the interior of the sides 17 as shown in FIGS. 22 and 25.

These flaps 67 typically would have enough outward flex being bent against the edge 71*a* of the bottom section in order to frictionally push the flaps 67 against the interior of the sides 17*a* to keep the base 27 in place. In order to assist this, flap 67 one could be equipped with a seal which in FIG. 26 is tape 69 which may have a tape cover 70 which can be peeled off when the box is assembled.

FIG. 23 shows how there may be cutouts 72 so that the base flaps 67 are formed on all of the corners and join when folded upward against edge 71.

There are punchouts 23*b* at each of the corners of the bottom section which take advantage of the corners to allow them to flex inward so that they can go contact punchouts 42 in the top section 1.

Preferably, each side 17 is of identical size so that the box forms a perfect five or six sided box.

Referring to FIG. 26 it can be seen that there is an interior space 32 of the top section and an interior space 32*a* of the bottom section. The sides 17 of the top section facing away from the interior space 32 preferably are designed to frictionally contact the sides 17*a* facing the interior space 32*a* to provide support and to keep the top and bottom section in place relative to one another.

Opposite the interior space is the exterior 80 of the top section and 80*a* of the bottom section.

The top section has a top with a top section top perimeter 77 defined by the top of the flat sides, and a bottom perimeter 78 defined by the bottom of the flat sides. The bottom section also has a top perimeter 77*a* defined by the top of the flat sides, preferably designed to allow the frictional contact described in the preceding paragraph relative to the top section bottom perimeter. The bottom section also has a bottom perimeter 78*a* defined by the bottom of the flat sides.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

The invention claimed is:

1. A collapsing garbage can for holding garbage bags comprising:

at least one bottom section (3) comprised of four bottom section flat sides (17*a*), each bottom section flat side having two bottom section side edges (71*a*) and a bottom section hinge means (48*a*) for flexibly joining one bottom section edge of a bottom section flat side to one bottom section edge of an adjacent bottom section flat side said bottom section defining an interior space (32*a*), and a bottom section exterior (80*a*), a bottom section top perimeter 77*a* defining the top of the bottom section and a bottom section base perimeter 78*a* defining the bottom of the bottom section;

and at least one top section (1) comprised of four top section flat sides (17) corresponding in number to the bottom section flat side, each top section flat side having two top section side edges (71) and a top section hinge means (48) for flexibly joining one top section side edge of a top section flat side to one top section side edge of an adjacent top section flat side said top section defining an interior space (32), and a top section top perimeter (77)

defining the top of the top section and a top section bottom perimeter (78) defining the bottom of the bottom section and top section exterior (80);

and wherein the top section flat sides are slidably juxtaposed against the bottom section flat sides and further comprising a locking means for fixing the position of the top section relative to the bottom section and wherein the bottom section flat side hinge means comprise flexible material and wherein the locking means comprises the the top section between the top section bottom perimeter and the top section top perimeter fitting into the top perimeter of the bottom section where the flexible material is bent inward, wherein said can further comprises a can bottom at the bottom section bottom said can bottom extending along the base perimeter of the bottom section bottom and in frictional contact with the bottom section interior to secure the position of the bottom section sides against the can bottom.

2. The garbage can of claim 1 wherein the at least one bottom section is comprised of paper with a waterproof coating.

3. The invention of claim 1 wherein said top section hinge means further comprises a flexible connection of two adjoining top section flat sides for allowing each top section flat side to fold against an adjoining top section flat side or move away from an adjoining top section flat side and wherein the bottom section hinge means comprises a flexible connection 48 of two adjoining bottom section flat sides for allowing each bottom section flat side to fold against an adjoining bottom section flat side or move away from an adjoining bottom section flat side.

4. The invention of claim 1 wherein the locking means further comprises frictional contact between the top section exterior and the bottom section interior for the top section bottom perimeter within the bottom section top perimeter.

5. The invention of claim 1 wherein sides are made of cardboard.

* * * * *